US007021757B2

(12) United States Patent
Kida

(10) Patent No.: US 7,021,757 B2
(45) Date of Patent: Apr. 4, 2006

(54) BOTH-SIDE RECORDING APPARATUS

(75) Inventor: Akira Kida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/899,075

(22) Filed: Jul. 27, 2004

(65) Prior Publication Data

US 2005/0024463 A1 Feb. 3, 2005

(30) Foreign Application Priority Data

Jul. 31, 2003 (JP) ..... 2003-284077

(51) Int. Cl.
*B41J 13/00* (2006.01)

(52) U.S. Cl. ..... 347/104; 271/186; 271/225

(58) Field of Classification Search ..... 347/104; 271/186, 225

See application file for complete search history.

(56) References Cited

U.S. PATENT DOCUMENTS

| | | | | |
|---|---|---|---|---|
| 5,438,435 | A * | 8/1995 | Lawniczak | 358/496 |
| 5,836,706 | A * | 11/1998 | Ruhe | 400/636 |
| 5,867,196 | A | 2/1999 | Kiyohara et al. | 347/104 |
| 5,874,979 | A * | 2/1999 | Ohyama | 347/104 |
| 5,886,729 | A | 3/1999 | Hiramatsu et al. | 347/264 |
| 5,899,451 | A | 5/1999 | Kiyohara et al. | 271/167 |
| 5,992,993 | A | 11/1999 | Kiyohara et al. | 347/104 |
| 6,045,220 | A | 4/2000 | Kiyohara et al. | 347/104 |
| 6,095,515 | A | 8/2000 | Kiyohara et al. | 271/161 |
| 6,103,985 | A * | 8/2000 | Shell et al. | 209/587 |
| 6,131,899 | A | 10/2000 | Nojima et al. | 271/121 |
| 6,200,043 | B1 | 3/2001 | Inoue et al. | 400/88 |
| 6,250,827 | B1 | 6/2001 | Nojima et al. | 400/691 |
| 6,654,133 | B1 | 11/2003 | Inoue et al. | 358/1.12 |
| 6,659,603 | B1 * | 12/2003 | Kida et al. | 347/104 |
| 6,896,432 | B1 * | 5/2005 | Ohyama | 400/642 |
| 2003/0179272 | A1 * | 9/2003 | Saito et al. | 347/104 |

FOREIGN PATENT DOCUMENTS

JP 2001-270633 10/2001

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

A clear-cut high-quality printing result is obtained in a both-side recording apparatus. The both-side recording apparatus has first unevenness imparting means for imparting an uneven shape to a recording medium in a plane orthogonal to the conveying direction of the recording medium. The first unevenness imparting means comprises sheet expelling rollers, having a plurality of roller portions in a direction orthogonal to the conveying direction of the recording medium in the plane of the recording medium, conveying spurs for nipping the recording medium between them and each roller portion, and a plurality of push-in spurs disposed between the conveying spurs.

15 Claims, 14 Drawing Sheets

BOTH-SIDE RECORDING APPARATUS

This application claims priority from Japanese Patent Application No. 2003-284077 filed Jul. 31, 2004, which is hereby incorporated by reference herein.

BACKGROUND OF THE INVENTION

1. Field of the Invention

This invention relates to a both-side recording apparatus capable of effecting both-side printing which is provided with a conveying path for inversion.

2. Related Background Art

There has been put into practical use a both-side recording apparatus provided with a conveying path for inversion and capable of effecting both-side printing. An example of the basic construction thereof will hereinafter be described with reference to FIG. 15 of the accompanying drawings. The both-side recording apparatus 1 is of a construction in which recording is effected on one side of a recording medium P fed in from a sheet feeding portion 2 by a carriage portion 5 carrying a recording head (not shown) thereon while the recording medium P is conveyed in a forward conveying direction by a sheet conveying portion 3,4, whereafter the recording medium P is conveyed in a reverse direction and directed to an inverting portion 6, where the front side and reverse side of the recording medium P are inverted, whereafter the recording medium P is again conveyed to the sheet conveying portion, and recording is effected on the reverse side by the carriage portion 5, and then the recording medium P is expelled from a sheet expelling portion (see, for example, Japanese Patent Application Laid-Open No. 2001-270633).

SUMMARY OF THE INVENTION

In recent years, the ink jet process of discharging ink drops to thereby effect printing has become a mainstream, but it is known that when recording by the ink jet process is effected, a difference occurs to the swelling of fibers constituting a recording medium due to the difference in the density of the ink, and uneven portions called cock rings occur to the recording medium during the recording thereon. Thus, the recording time is increased and also, the amplitude of the unevenness of the recording medium becomes great.

In a recording apparatus capable of effecting both-side printing, recording is effected on the front side of a recording medium, whereafter the front side and reverse side of the recording medium are inverted, whereafter the recording medium is again conveyed to the recording portion to thereby effect recording and therefore, recording is effected in a state in which cock rings have occurred, and as a result, the floating of the paper in a direction toward a recording head occurs, and the recording head and the recording medium rub against each other and in some cases, the quality of an image is spoiled.

Also, to obtain a clear-cut and high-quality printing result, it is required to set the interval between the front side of the recording medium and the recording head (hereinafter referred to as the "inter-sheet interval") as narrow as possible.

In view of the above-noted situation, it is an object of the present invention to set the inter-sheet interval as narrow as possible for both of the front side and reverse side of a recording medium, and prevent the floating of the recording medium toward a recording head side, in order to obtain a clear-cut and high-quality printing result in a both-side recording apparatus.

In order to achieve the above object, the both-side recording apparatus of the present invention is a both-side recording apparatus for effecting recording on both sides of a recording medium while conveying the recording medium, and has first unevenness imparting means for imparting an uneven shape to the recording medium in a plane orthogonal to the conveying direction of the recording medium when recording is effected on each of the front side and reverse side of the recording medium. By thus forcibly forming a predetermined uneven surface on the recording medium, even when unevenness by cock rings occurs to the recording medium, excessively great unevenness can be prevented, and a clear-cut and high-quality printing result can also be obtained on the reverse side of the recording medium.

The both-side recording apparatus of the present invention further has second unevenness imparting means provided at a location substantially opposed to recording means for effecting recording on the recording medium, for imparting an uneven shape to the recording medium in a plane orthogonal to the conveying direction of the recording medium when recording is effected on each of the front side and reverse side of the recording medium. Thereby, it becomes possible to form a predetermined uneven surface directly on the recording medium at a position for effecting recording on the recording medium. Furthermore, the both-side recording apparatus of the present invention is designed such that the convex portion generating position of the first unevenness imparting means and the convex portion generating position of the second unevenness imparting means substantially coincide with each other. Thereby, it becomes possible to form the uneven shape more reliably, and a clear-cut and high-quality printing result can also be obtained on the reverse side of the recording medium.

In the both-side recording apparatus of the present invention, the first unevenness imparting means comprises a rotary member having a plurality of roller portions in a direction orthogonal to the conveying direction of the recording medium in the plane of the recording medium, conveying spurs for nipping the recording medium between the roller portions, and a plurality of push-in spurs disposed between the conveying spurs, and design can be made such that the push-in spurs push in the recording medium, whereby the convex portion of the recording medium is formed on that portion of the recording medium which contacts with the roller portions. The recording apparatus usually has a sheet expelling rotary member and a spur, and by using these parts as the unevenness imparting means, the solution of the above-noted problem can be achieved economically.

The first unevenness imparting means comprises a plurality of ribs extending in parallelism to the conveying direction of the recording medium, and a sheet pressing plate for nipping the recording medium between the ribs, and the sheet pressing plate has a plurality of projections disposed between the ribs substantially in parallelism to the ribs, and design can also be made such that the projections push in the recording medium, whereby the convex portion of the recording medium is formed on that portion of the recording medium which contacts with the ribs. Thereby, it becomes possible to form an uneven shape on the recording medium by relatively simple structure. The first projection may be a rotary member rotated in the conveying direction of the recording medium.

The first unevenness imparting means can be provided in a portion common to the route from the recording medium supplying portion to recording means and the route from an inverted portion in which the front side and reverse side of the recording medium are inverted. Thereby, not only when recording is effected on the front side of the recording medium, but also when recording is effected on the reverse side of the recording medium, a similar uneven shape can be formed, and a clear-cut and high-quality printing result can be obtained.

The first unevenness imparting means is provided between the recording means and a sheet expelling portion, and design can also be made such that after recording has been effected on the front side of the recording medium and before recording is effected on the reverse side of the recording medium, unevenness is imparted to the recording medium by the first unevenness imparting means. Thereby, the sheet expelling rotary member and spur can be effectively used as the unevenness imparting means.

The second unevenness imparting means can be a platen provided with a plurality of projections extending in the conveying direction of the recording medium. The platen is usually provided in a recording apparatus, and can simply provided with a simple projection to thereby form an uneven shape economically and reliably on the recording medium. The projection may be a rotary member rotated in the conveying direction of the recording medium.

According to the present invention, before recording is effected on the reverse side of the recording medium, an uneven waving shape can be forcibly formed on the recording medium to thereby prevent the floating of the recording medium toward the recording head side also when recording is effected on the reverse side of the recording medium. Therefore, it becomes possible to make the inter-sheet interval narrower and secure a printing range more widely than in the conventional both-side printing apparatus, and a clear-cut and high-quality printing result can be obtained.

DESCRIPTION OF THE PREFERRED EMBODIMENTS

Figure 1:
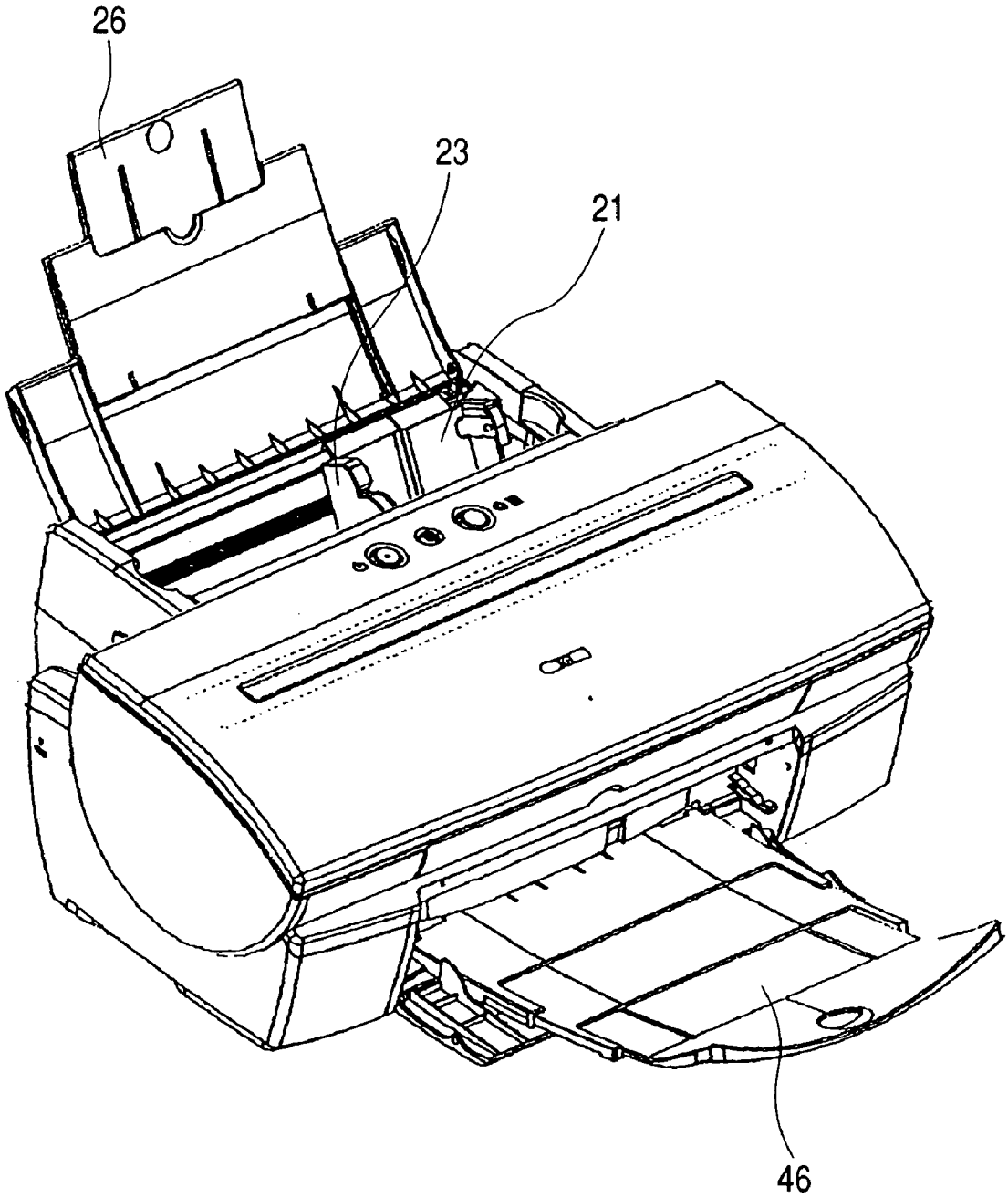
FIG. 1 is a perspective view of a both-side recording apparatus according to a first embodiment of the present invention.
Figure 2:
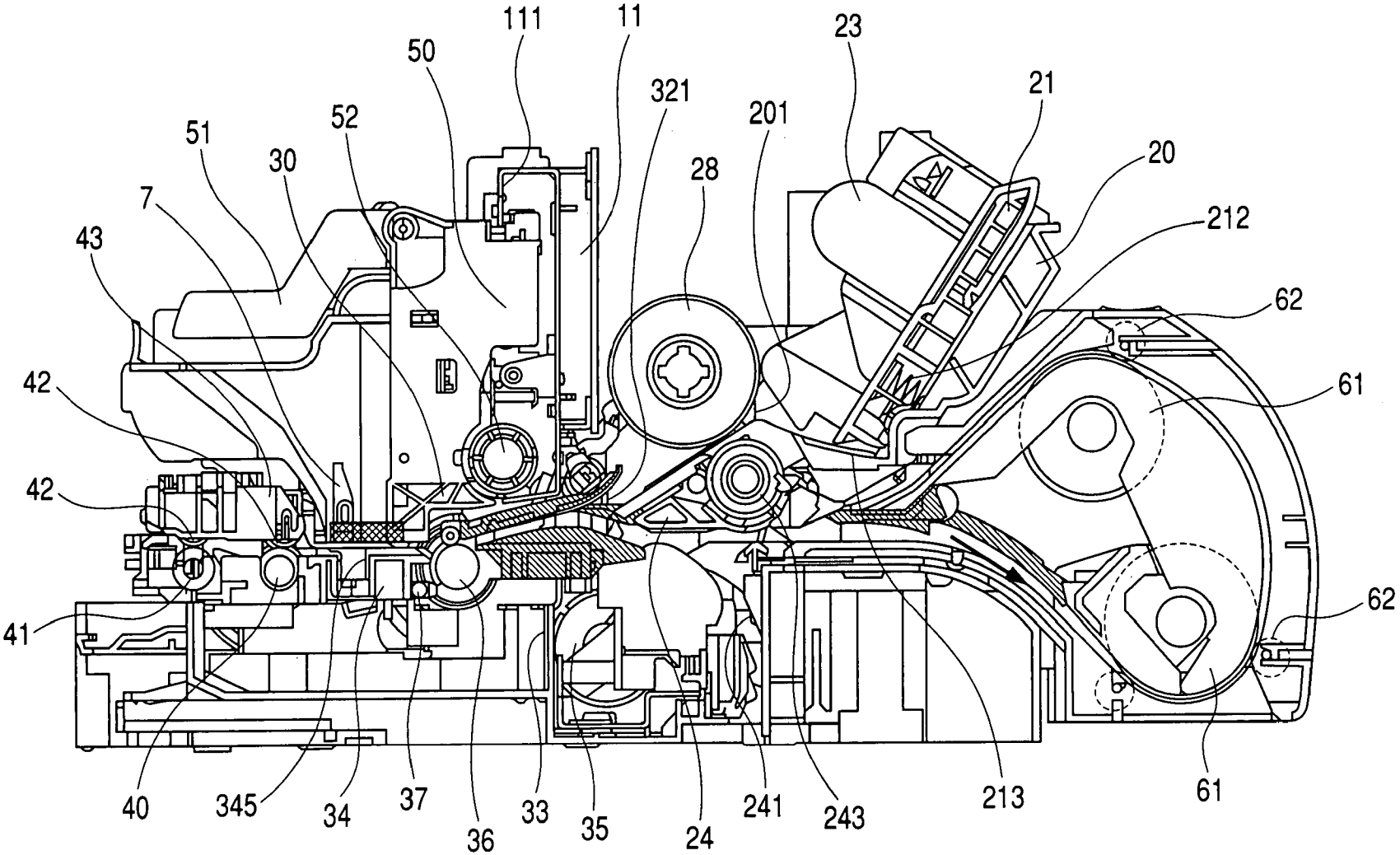
FIG. 2 is a cross-sectional view of the both-side recording apparatus according to the first embodiment of the present invention.
Figure 3:
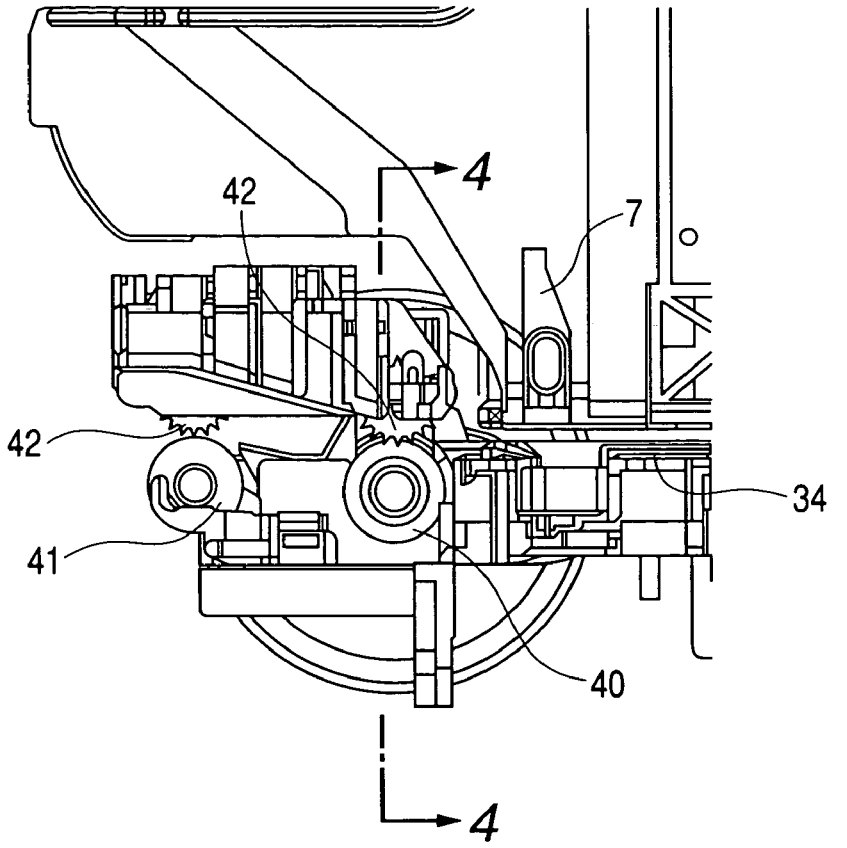
FIG. 3 is an enlarged cross-sectional view of the sheet expelling portion and carriage portion of the both-side recording apparatus according to the first embodiment of the present invention.
Figure 4:
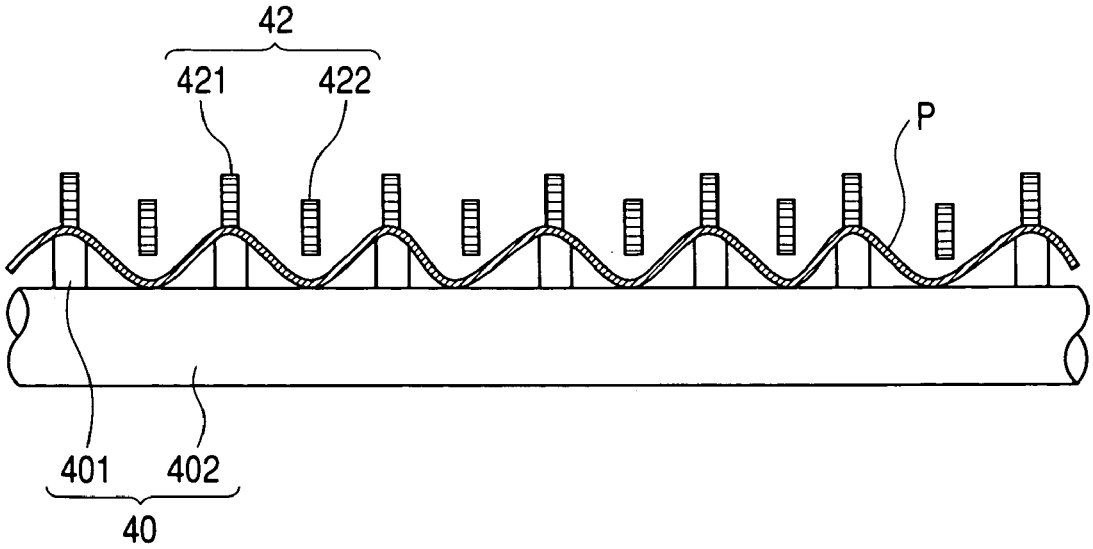
FIG. 4 is a typical view of the sheet expelling portion of the both-side recording apparatus according to the first embodiment of the present invention as it is seen from the conveying direction of a recording medium.
Figure 5:
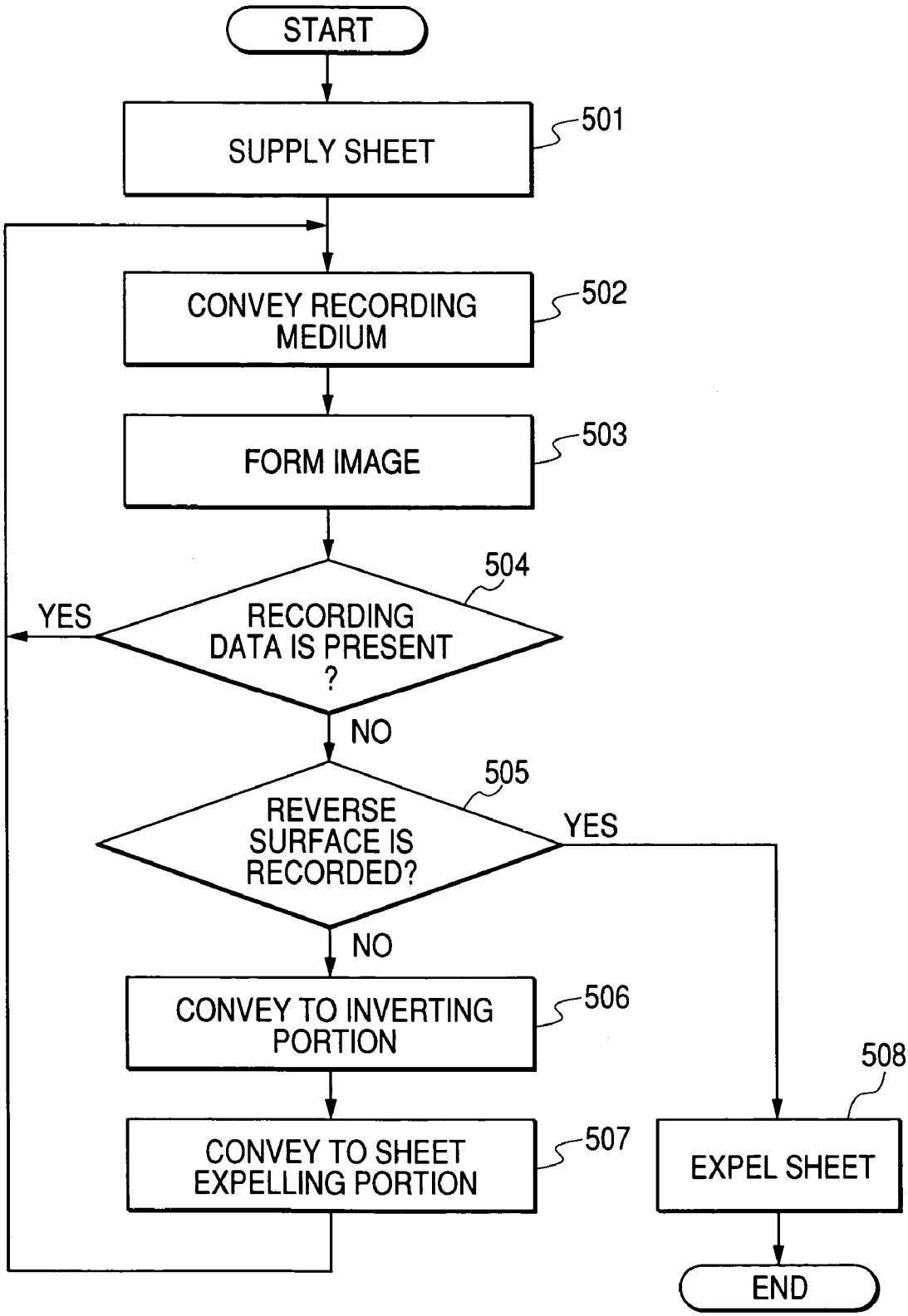
FIG. 5 is a flow chart showing the recording method of the both-side recording apparatus according to the first embodiment of the present invention.
Figure 14:
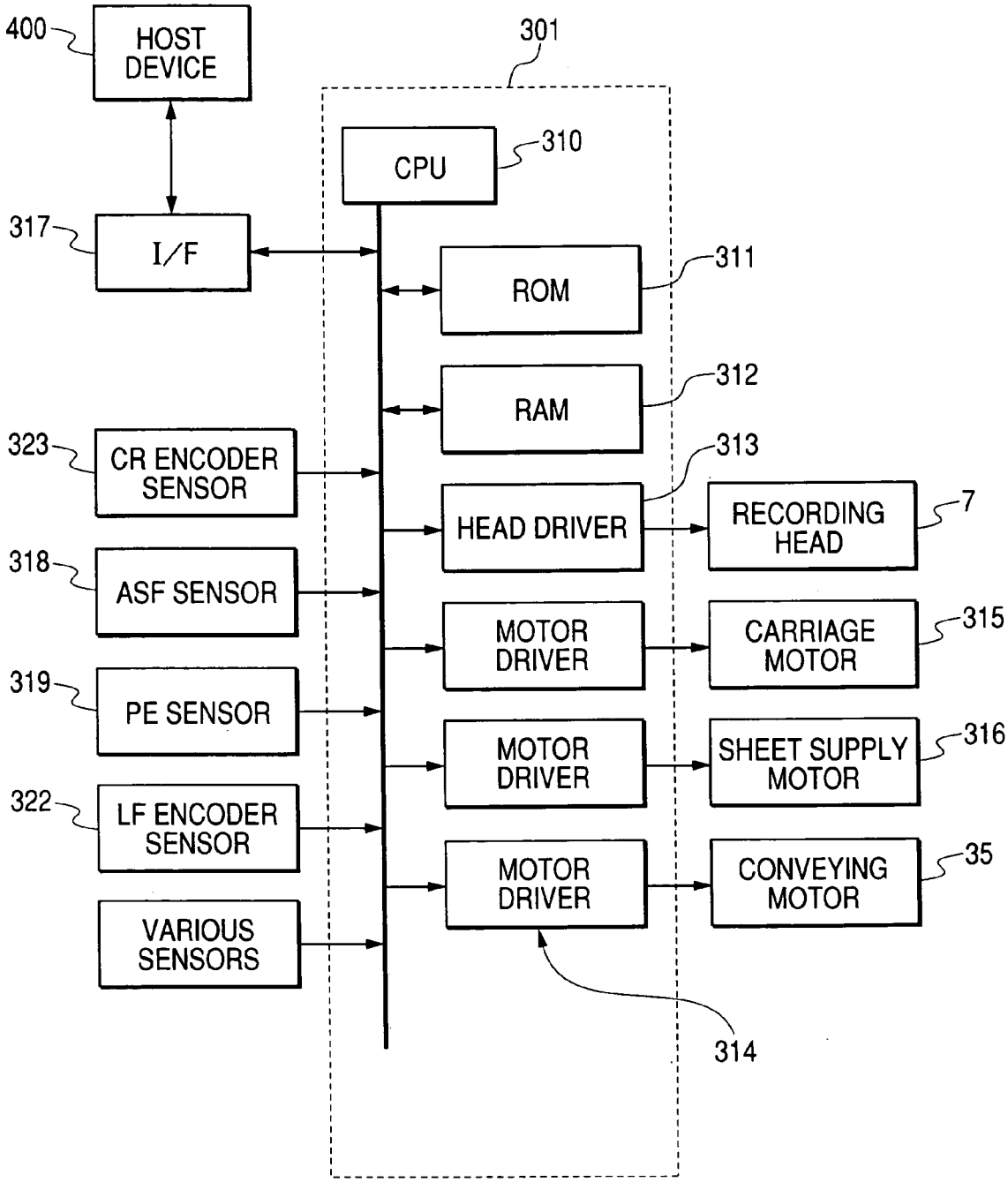
FIG. 14 is a control block diagram of a both-side recording apparatus to which the present invention is applied.

A first embodiment of the both-side recording apparatus of the present invention will hereinafter be described with reference to FIGS. 1 to 9A and 9B. FIG. 1 is a perspective view of the both-side recording apparatus according to the first embodiment of the present invention. FIG. 2 is a cross-sectional view of the both-side recording apparatus according to the first embodiment of the present invention. FIG. 3 is an enlarged cross-sectional view of a sheet expelling portion and a carriage portion. FIG. 4 is a typical view of the sheet expelling portion as it is seen from the conveying direction of a recording medium. FIG. 5 is a flow chart showing a series of steps of effecting recording on the recording medium P. FIGS. 6A and 6B to 9A and 9B are typical views showing the states of the recording medium P at the main steps shown in FIG. 5. FIG. 14 is a control block diagram of the both-side recording apparatus.

Figure 15:
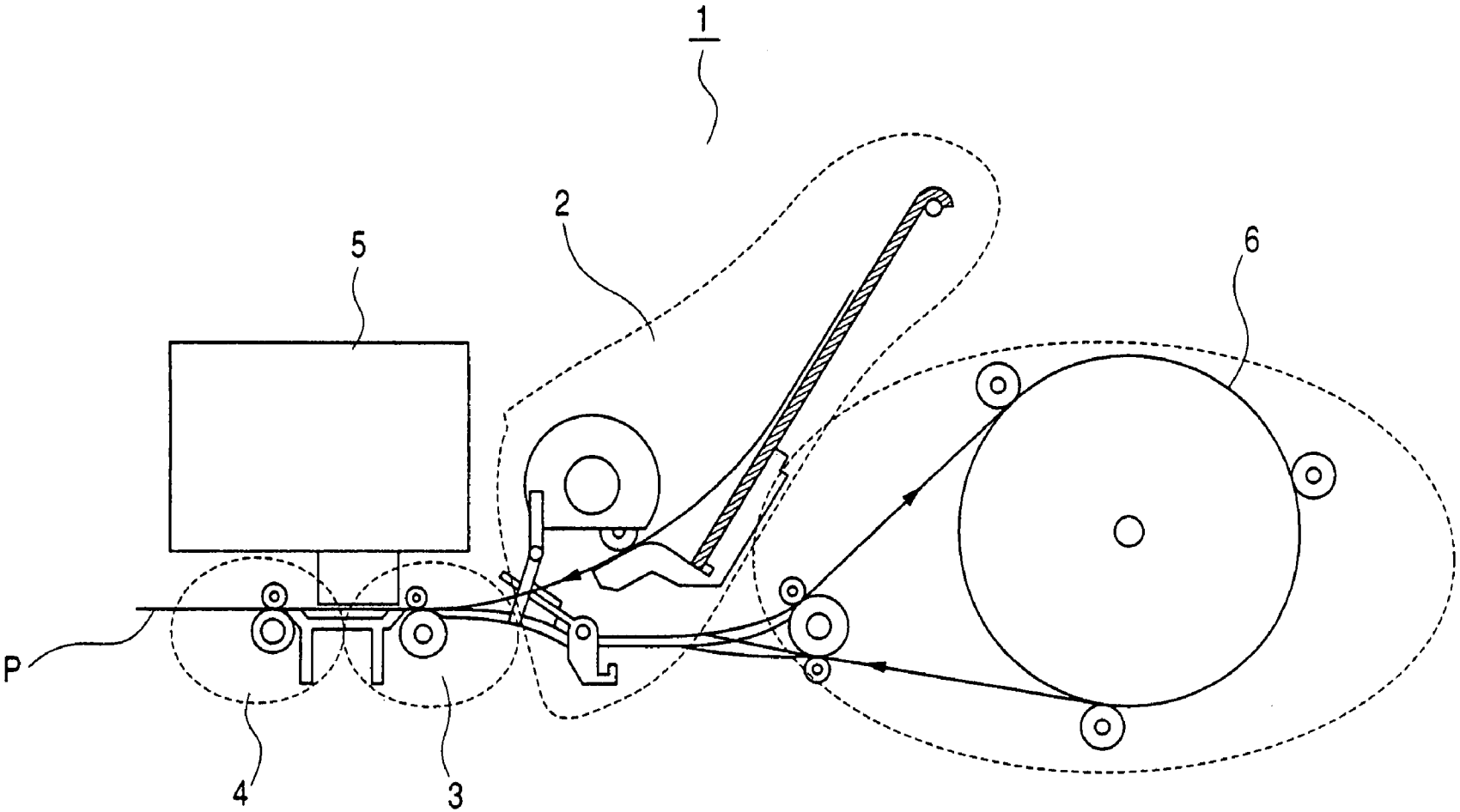
FIG. 15 PRIOR ART
FIG. 15 schematically shows the construction of a conventional both-side recording apparatus.

The basic construction of the both-side recording apparatus 1 according to the present embodiment is a construction equal to that of the conventional both-side recording apparatus, and like the construction shown in FIG. 15, it is comprised of a sheet supplying portion, a sheet conveying portion, a sheet expelling portion, a carriage portion, an inverted portion and an electrical portion (not shown) or the like. With reference chiefly to FIG. 2 and suitably to other figures, the construction of each of these regions will hereinafter be schematically described.

(A) The sheet supplying portion is of a construction in which a pressure plate 21 for stacking recording mediums P thereon, a sheet supplying roller 28 for supplying the recording mediums P, a separating roller 241 for separating the recording mediums P one by one, etc. are mounted on a base 20.

As shown in FIG. 1, a sheet supplying tray 26 for holding the stacked recording mediums P is mounted on the base 20 or an outer package. The sheet supplying tray 26 is of a multi-stage type, and is drawn out during the use thereof.

The sheet supplying roller 28 is a bar-like member having a circular cross section. A piece of separating roller rubber (not shown) is provided on the sheet reference side, whereby the recording mediums P are supplied. The sheet supplying roller 28 is driven by an exclusively sheet supplying motor 316 provided in the sheet supplying portion through a drive transmitting gear (not shown).

A movable side guide 23 is movably provided on the pressure plate 21 (see FIG. 1), and regulates the stacked position of the recording mediums P. The pressure plate 21 is rotatable about a rotary shaft (not shown) supported by the base 20, and comes into contact with or comes away from the sheet supplying roller 28 depending on the rotated position of a pressure plate cam (not shown). The pressure plate 21 is urged against the sheet supplying roller 28 by a pressure plate spring 212. On that region of the pressure plate 21 which is opposed to the sheet supplying roller 28, there is provided a separating sheet 213 formed of a material having a great coefficient of friction such as artificial leather to prevent double feeding when the remaining number of the stacked recording mediums P has become small.

Further, on the base 20, there is provided a separating roller 241 for separating the recording mediums P one by one, the separating roller 241 being supported by a separating roller holder 24. The separating roller holder 24 is rotatable about a rotary shaft (not shown) provided on the base 20, and is urged against the sheet supplying roller 28 by a separating roller spring (not shown). A clutch spring 243 is attached to the separating roller 241, and design is made such that when a predetermined or greater load is applied, that portion of the separating roller 241 to which the clutch spring is attached can be rotated. The separating roller 241 comes into contact with or comes away from the sheet supplying roller 28, depending on the rotated position of a control cam (not shown). The positions of the pressure plate 21 and the separating roller 241 are detected by an auto sheet feeder (ASF) sensor 318 (see FIG. 14).

Description will hereinafter be made of the operation of each portion when the recording mediums P are supplied.

In an ordinary standby state, the pressure plate 21 is spaced apart from the sheet supplying roller 28 by a pressure plate cam, and the separating roller 241 is also spaced apart from the sheet supplying roller 28 by the control cam. When sheet supply is started, the separating roller 241 is first urged against the sheet supplying roller 28, and next the pressure plate 21 is urged against the sheet supplying roller 28, by the driving of a motor. In this state, the supply of the recording mediums P is started. The number of the recording mediums P is limited by a pre-stage separating portion 201 provided on the base 20, and only a predetermined number of sheets are fed to between the sheet supplying roller 28 and the separating roller 241. There, the uppermost recording medium P is separated and conveyed.

When the recording medium P arrives at a conveying roller 36 and pinch rollers 37 which will be described later, the pressure plate 21 and the separating roller 28 are spaced apart from the sheet supplying roller 28 by the pressure plate cam and the control cam, respectively.

(B) The sheet conveying portion is mounted on a chassis 11 comprising a bent-up metal plate. The sheet conveying portion is comprised of the conveying roller 36 as conveying means for conveying the recording medium P, the pinch rollers 37, a pinch roller holder 30, a PE sensor 319, a PE sensor lever 321, etc.

The conveying roller 36 is comprised of a metal shaft having its surface coated with fine particles of ceramics, and the metal portion of the metal shaft is supported by a bearing (not shown) mounted on the chassis 11. The conveying roller 36 is driven by a conveying motor 35 comprising a DC motor. Also, on the shaft of the conveying roller 36, there is provided a code wheel (not shown) formed with a marking at a pitch of 150–300 lpi to detect the conveying amount of the recording mediums P, and an encoder sensor 322 for reading it is mounted at a location on the chassis 11 to which the code wheel is adjacent.

A plurality of pinch rollers 37 driven to rotate by the conveying roller 36 are held and provided on a pinch roller holder 30. The pinch roller holder 30 is supported by a bearing (not shown) by which a rotary shaft is mounted on the chassis 11, and is rotated about the rotary shaft. The pinch rollers 37 are urged against the conveying roller 36 by a pinch roller spring (not shown), whereby a conveying force for the recording mediums P is produced. Also, the pinch roller holder 30 is provided with a PE sensor lever 321 for detecting the leading edge portion and trailing edge portion of the recording medium P and transmitting a signal.

At the entrance of the sheet conveying portion to which the recording medium P is conveyed, there are provided a paper guide flapper 33 and a platen 34 for guiding the recording medium P. The platen 34 is mounted at a fixed position by the chassis 11. On the platen 34, there are formed ribs 345 supporting the recording medium P and providing a conveying reference surface, and the platen 34 and the ribs 345 together constitute second unevenness imparting means. The ribs 345 are convex portions extending on the upper surface of the platen 34 in parallelism to the conveying direction of the recording medium P, and a plurality of ribs 345 are provided at intervals, and control the gap with respect to a recording head 7 as recording means, and besides, has the function of cooperating with a sheet expelling portion which will be described later to control the waving of the recording medium P so as not to become great. It is possible not only to construct the ribs 345 as such static members, but also to constitute them by a rotary member rotatable in the conveying direction of the recording medium P. The paper guide flapper 33 is fitted to the conveying roller 36, is rotatable about a bearing (not shown) and is urged against and positioned on the chassis 11.

The recording medium P conveyed to the sheet conveying portion is guided by the pinch roller holder 30 and the paper guide flapper 33, and is sent to the pair of conveying roller 36 and pinch rollers 37, and is further conveyed on the platen 34 by the rotation of the pair of rollers. The PE sensor lever 321 detects the leading edge of the recording medium P conveyed thereto, and finds the printing position for the recording medium P.

(C) The carriage portion has a carriage 50 for mounting the recording head 7 thereon. The carriage 50 is supported by a guide shaft 52 for reciprocally scanning the carriage 50 in a direction perpendicular to the conveying direction of the recording medium P, and a guide rail 111 for holding the rear end of the carriage 50 and maintaining a gap between the recording head 7 and the recording medium P. The guide shaft 52 is mounted on the chassis 11, and the guide rail 111 is formed integrally with the chassis 11. The carriage 50 is driven in a direction perpendicular to the conveying direction of the recording medium P by a carriage motor 315 mounted on the chassis 11 through a timing belt (not shown). The timing belt is passed over and supported by idle pulleys (not shown).

The recording head 7 for forming an image on the basis of image information is provided at a recording position downstream of the conveying roller 36 with respect to the conveying direction of the recording medium P. The recording head 7 is fixed to the carriage 50 by a head set lever 51. That is, the head set lever 51 has a ramming portion for positioning, and pressing means for pressing and fixing, and is rotated about a rotation fulcrum, whereby the recording head 7 is fixed to the carriage 50.

The recording head 7 used is of an ink jet type on which are carried interchangeable discrete ink tanks (not shown) of respective colors. The recording head of the ink jet type is provided with a minute liquid discharge port (orifice), a liquid path, an energy acting portion provided in a portion of this liquid path, and energy generating means for generating liquid droplet forming energy caused to act on a liquid in the acting portion. As energy generating means for generating such energy, there is a recording method using an electromechanical conversion member such as a piezoelectric element, a recording method using energy generating means for applying an electromagnetic wave such as a laser to thereby generate heat, and discharging a liquid droplet by the action of the heat generation, or a recording method using energy generating means for heating a liquid by an electro-thermal conversion member such as a heat generating element having a heat generating resistance member.

Above all, a recording head used in the ink jet recording method of discharging a liquid by heat energy enables liquid droplet discharge ports (orifices) for discharging recording liquid droplets and forming liquid droplets for discharging to be arranged at high density and therefore, can effect recording of high resolution. Especially, a recording head using an electro-thermal conversion member as energy generating means is easy to make compact, and is advantageous in that it can sufficiently make the most of the latest progress of technology in the field of semiconductor and the merits of the IC technology and micro processing technology remarkable in the improvement in reliability, and is easy to mount at high density and is also low in the manufacturing cost. For such a reason, in the present embodiment, use is made of the ink jet type using an electro-thermal conversion member as energy generating means. That is, ink is heated by a heater or the like provided in the recording head 7, and film-boils, and is subjected to a change in pressure resulting from the growth or contraction of a bubble, and is discharged from the nozzle of the recording head 7, whereby an image is formed on the recording medium P. The present invention is not restricted to this type, but can also be applied to a recording method using the above-mentioned electromechanical conversion member, or recording means using an electromagnetic wave or the like.

In order to detect the position of the carriage 50, a code strip (not shown) formed with marking at a pitch of 150–300 lpi is provided in parallelism to the timing belt. Further, an encoder sensor 323 for reading it is provided on a carriage substrate (not shown) carried on the carriage 50. On the carriage substrate, there is provided a contact portion (not shown) for effecting electrical connection to the recording head 7. Also, the carriage 50 is provided with a flexible substrate (not shown) for transmitting a head signal from an electric substrate (control substrate 301) to the recording head 7.

The steps of forming an image on the recording medium P are as follows. First, the recording medium P is conveyed to a column position for forming an image (a position in the conveying direction of the recording medium P) by the conveying roller 36 and the pinch rollers 37. Therewith, the carriage 50 is moved to a row position for forming an image (a position perpendicular to the conveying direction of the recording medium P), to thereby oppose the recording head 7 to the image forming position. Thereafter, by a signal from the electric substrate, the recording head 7 discharges the ink toward the recording medium P, whereby a predetermined image is formed.

(D) The sheet expelling portion is shown on an enlarged scale in FIG. 3. A portion of the sheet expelling portion constitutes first unevenness imparting means. The first unevenness imparting means comprises sheet expelling rollers 40, 41 having a plurality of roller portions 401 in a direction orthogonal to the conveying direction of the recording medium P in the plane of the recording medium P, conveying spurs 421 for nipping the recording medium P between them and each roller portion 401, and a plurality of push-in spurs 422 disposed between the conveying spurs 421.

The sheet expelling rollers 40 and 41 are mounted on the platen 34. The sheet expelling roller 40 provided on the upstream side with respect to the conveying direction of the recording medium P is comprised of a plurality of rubber roller portions 401 provided at intervals on a metal shaft 402. The sheet expelling roller 41 provided on the downstream side is likewise comprised of a plurality of rubber roller portions (not shown) provided at intervals on a metal shaft (not shown). The sheet expelling roller 40 is driven by the rotational force of the conveying roller 36 being transmitted thereto by an idler gear, and the sheet expelling roller 41 is driven by the rotational force of the sheet expelling roller 40 being transmitted thereto by an idler gear. The roller portions 401, etc. are disposed so as to overlap the ribs 345 at the same position when seen from the conveying direction of the recording medium P. As the roller portions 401, etc., use may be made of other elastic material than rubber if it has a frictional force necessary to convey the recording medium P. Also, the roller portions 401 may be of a construction in which rubber is adhesively secured to the metallic roller portions.

The spur 42 constituting a rotary member is comprised of a thin plate of stainless steel provided with a plurality of convex projections on the outer peripheral surface thereof, and a resin portion, the thin plate and the resin portion being molded integrally with each other, and is mounted on a spur holder 43. The spur 42 is urged against the sheet expelling rollers 40 and 41 by a spur spring (not shown) comprising a coil spring provided in a bar shape, in the interior of the spur holder 43, and can be driven to rotate by the sheet expelling rollers 40 and 41.

FIG. 4 is a typical view of the sheet expelling roller 40 and the spurs 42 as they are seen from the conveying direction of the recording medium P, and shows a cross section taken along the line 4—4 of FIG. 3. The spur 42 is comprised of a conveying spur 421 and a push-in spur 422. The conveying spur 421 is provided in opposed relationship with the roller portion 401 of the sheet expelling roller 40, and the recording medium P passes between the conveying spurs 421 and the roller portion 401 to thereby generate a conveying force chiefly for the recording medium P. The push-in spur 422 is provided substantially at the intermediate position of the roller portion 401 and below the conveying spur 421, and downwardly urges the recording medium P to thereby suppress the floating-up of the recording medium P.

While in the foregoing, the sheet expelling roller 40 has been described, the sheet expelling roller 41 is entirely similar in construction to the sheet expelling roller 40 and therefore need not be described.

(E) The inverting portion is comprised of an inversion conveying roller 61, an inversion pinch roller 62, etc. The inversion pinch roller 62 is urged against the inversion conveying roller 61 by an inversion pinch roller spring (not shown). The inversion conveying roller 61 is driven by the conveying motor 35 through a gear (not shown).

The recording medium P having an image formed on its front side by the carriage portion is conveyed in a direction opposite to a sheet expelling direction by the conveying roller 36 and the pinch roller 37, and is guided and directed to the inverting portion by the pinch roller holder 30 and the paper guide flapper 33. The recording medium P is rotated by 180° along the outer peripheral surface of the inversion conveying roller 61 while being guided by the inversion conveying roller 61 and the inversion pinch roller 62, and has its front side and reverse side inverted and is again conveyed to the conveying roller 36 and the pinch rollers 37. As described in the description of the sheet conveying portion, the recording medium P is then conveyed to the recording capable position of the recording head 7, and recording is effected on the reverse side of the recording medium P. The recording medium P having images formed on its front side and reverse side is conveyed by the sheet expelling rollers 40, 41 and the spurs 42, and is expelled onto a sheet expelling tray 46 (see FIG. 1).

FIG. 14 is a control block diagram of the entire both-side recording apparatus.

The control substrate 301 is provided with a CPU 310 for governing the control of the both-side recording apparatus, and outputting various control commands, a ROM 311 into which control data or the like is written, a RAM 312 which is an area for evolving recording data or the like etc.

The reference numeral 313 designates a head driver for driving the recording head 7, and the reference numeral 314 denotes a plurality of motor drivers for driving the carriage motor 315, the sheet supplying motor 316 and the conveying motor 35, respectively. The reference numeral 317 designates an interface for effecting the transmission and reception of data to and from a host device 400 such as a computer or a digital camera.

A method of recording an image on the recording medium P by the both-side recording apparatus 1 of the present invention will now be specifically described with reference to FIG. 5.

First, one of the recording mediums P stacked on the sheet supplying portion is supplied to the sheet conveying portion (step 501). Next, the recording medium P nipped between the conveying roller 36 and the pinch rollers 37 is conveyed to an area the carriage portion scans (the column position for forming an image) with the rotation amount of the conveying roller 36 controlled (step 502). Then, the carriage 50 is moved to the row position for forming an image, and the ink is discharged from the recording head 7 carried on the carriage 50 toward the recording medium P to thereby form an image corresponding to one line (step 503).

After the image corresponding to one line has been formed, whether the recording data of the next line is present is judged (step 504), and if the data is present, the conveying roller 36 and the pinch rollers 37 are rotated by an amount corresponding to the conveying amount of one line to thereby convey the recording medium P, and the carriage 50 is moved to a predetermined row position to thereby form the next image (steps 502 and 503).

The steps 502 and 503 are repeatedly executed until the image data becomes absent, and when the recording of all image data is finished, whether recording on the reverse side is effected is confirmed (step 505). If the recording is not effected, the conveying roller 36 of the sheet conveying portion and the sheet expelling rollers 40 and 41 of the sheet expelling portion are reversely rotated to thereby convey the recording medium P from the carriage portion to the inverting portion (step 506), and invert the front side and reverse side of the recording medium P.

The recording medium P having had its front side and reverse side inverted is again conveyed to the sheet conveying portion. Here, the conveying roller 36 and the sheet expelling rollers 40, 41 are rotated in a forward direction to thereby once convey the recording medium P intactly to the position of the push-in spur 42 of the sheet expelling portion (step 507). Then, the conveying roller 36 and the sheet expelling rollers 40, 41 are again reversely rotated to thereby return the recording medium P to the column position for forming an image. By these series of operations, the reverse side of the recording medium P is set to the top line in which recording is effected. Thereafter, the steps 502 and 503 are repeated until the recording data becomes absent. Then, it is confirmed that the recording data for the reverse side has become absent (the step 505 of FIG. 5), and the recording medium P is expelled (the step 508 of FIG. 5), thus completing the recording.

Here, how the waving phenomenon of the recording medium P is controlled in the above-described recording method will be described with reference to FIGS. 6A and 6B to 9A and 9B. In each of FIGS. 6A and 6B to 9A and 9B, A and B typically show the position of the recording medium P in the conveying direction thereof and the paper floating situation of the recording medium P as it is seen from its conveying direction.

Figure 6A:
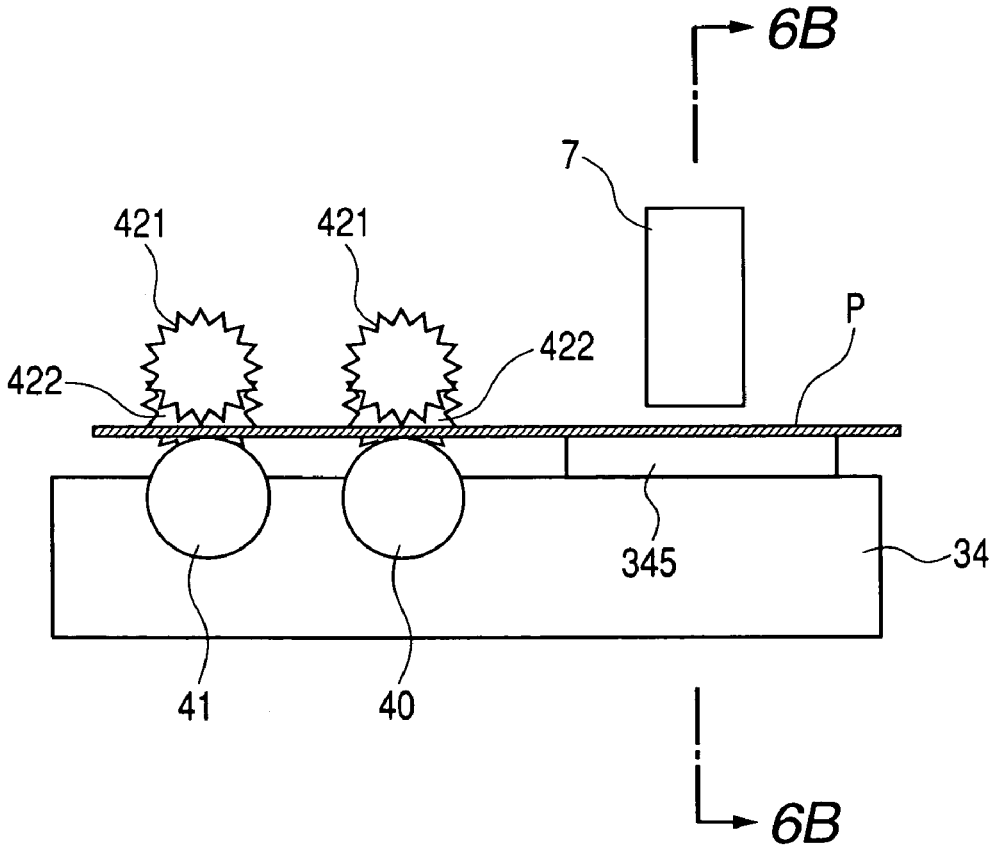
FIGS. 6A and 6B show a cross section of the both-side recording apparatus according to the first embodiment of the present invention during recording on the front side of the recording medium and the state of the recording medium.

FIG. 6A shows a state at a point of time whereat several lines have been recorded on the front side of the recording medium P. The recording medium P is nipped by and between the conveying roller 36, the pinch rollers 37 (not shown) and the sheet expelling rollers 40, 41, the spurs 42.

Figure 6B:
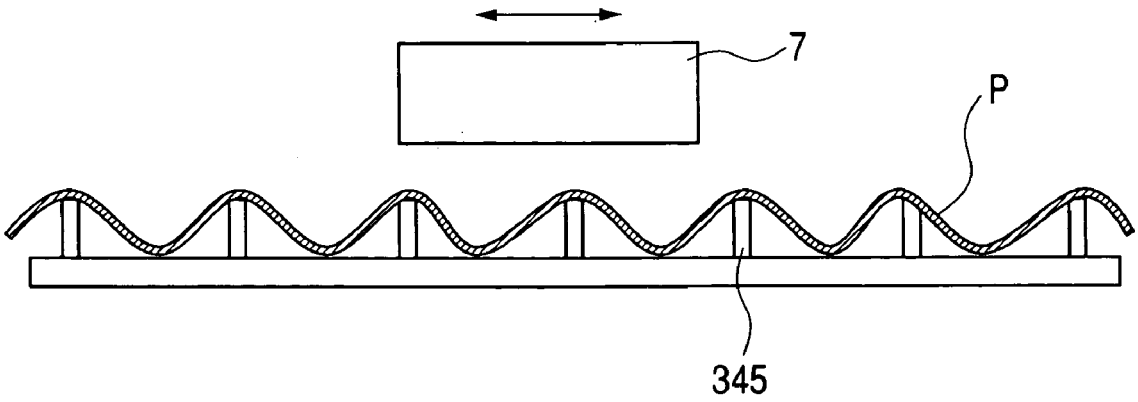

FIG. 6B shows the situation of the paper floating of the recording medium P right beneath the recording head 7. A plurality of uneven waving shapes are formed in the recording medium P by the action of the ribs 345 provided on the platen 34. The height of the waving of the recording medium P is suppressed to the height of the ribs 345 and therefore, there does not occur such a great paper floating that the recording head 7 and the recording medium P contact with each other.

Figure 7A:
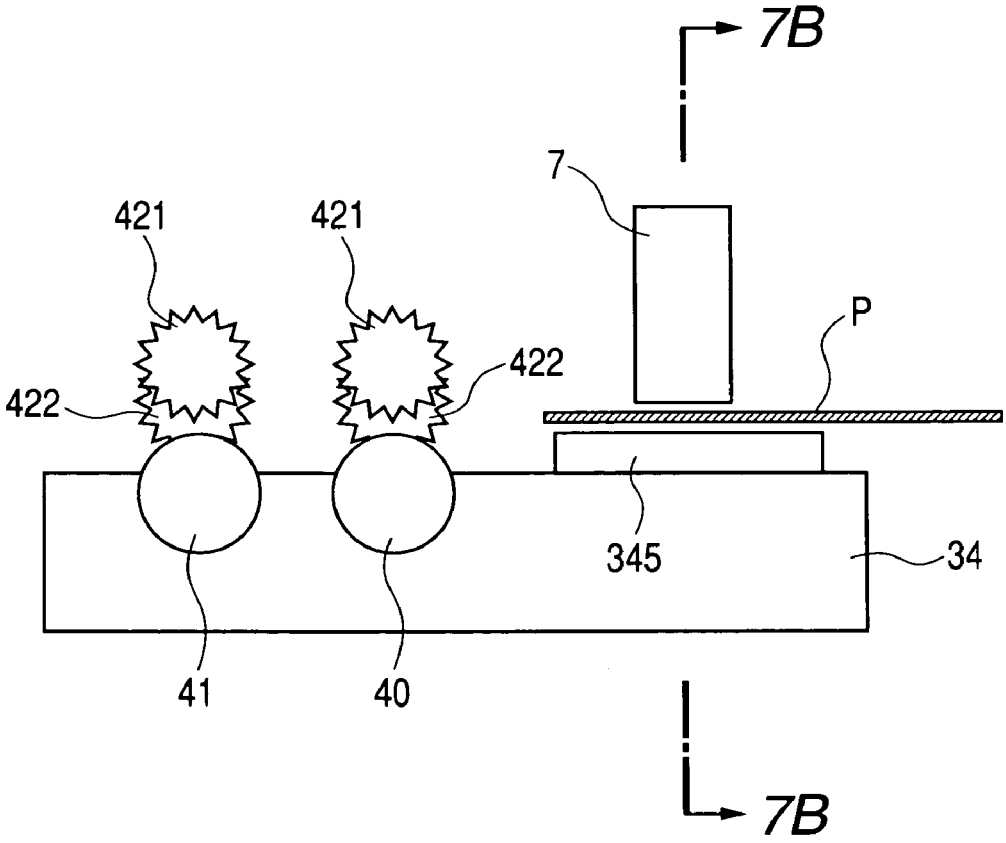
FIGS. 7A and 7B show a cross section of the both-side recording apparatus according to the first embodiment of the present invention after the inversion of the front side and reverse side of the recording medium and the state of the recording medium.
Figure 7B:
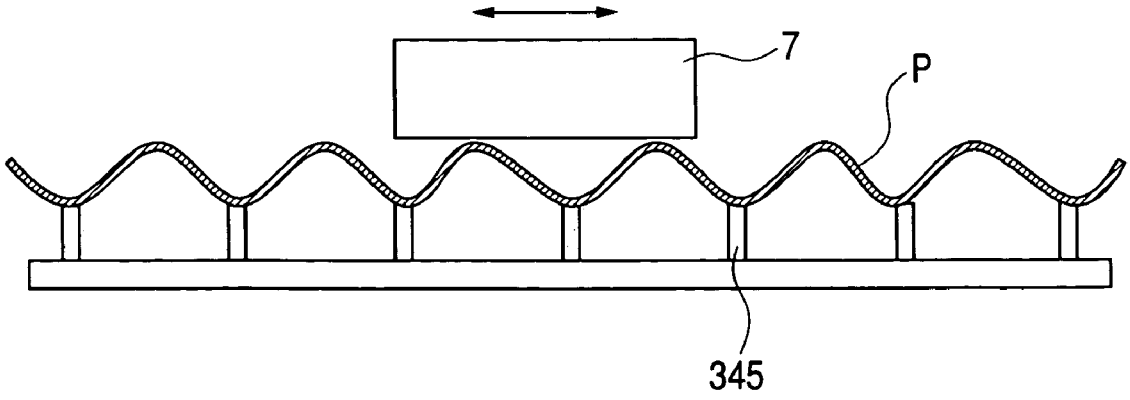

FIG. 7A shows a situation at a point of time whereat the recording medium P is converted to the inverting portion and is inverted (the step 506 of FIG. 5), and is again conveyed to the recording head 7. Also, FIG. 7B shows the situation of the paper floating of the recording medium P right beneath the recording head 7 (a cross section 7B—7B in FIG. 7A). As a result of having been inverted, the recording medium P has its unevenness vertically inverted about the top of the ribs 345, and that portion thereof which has been a concave portion before it is inverted conversely becomes a convex portion, and is generally close to the recording head 7. If recording is intactly effected, in the worst case, the recording medium P is in a state in which the stain of the recording medium P occurs due to the contact between the recording head 7 and the recording medium P.

Figure 8A:
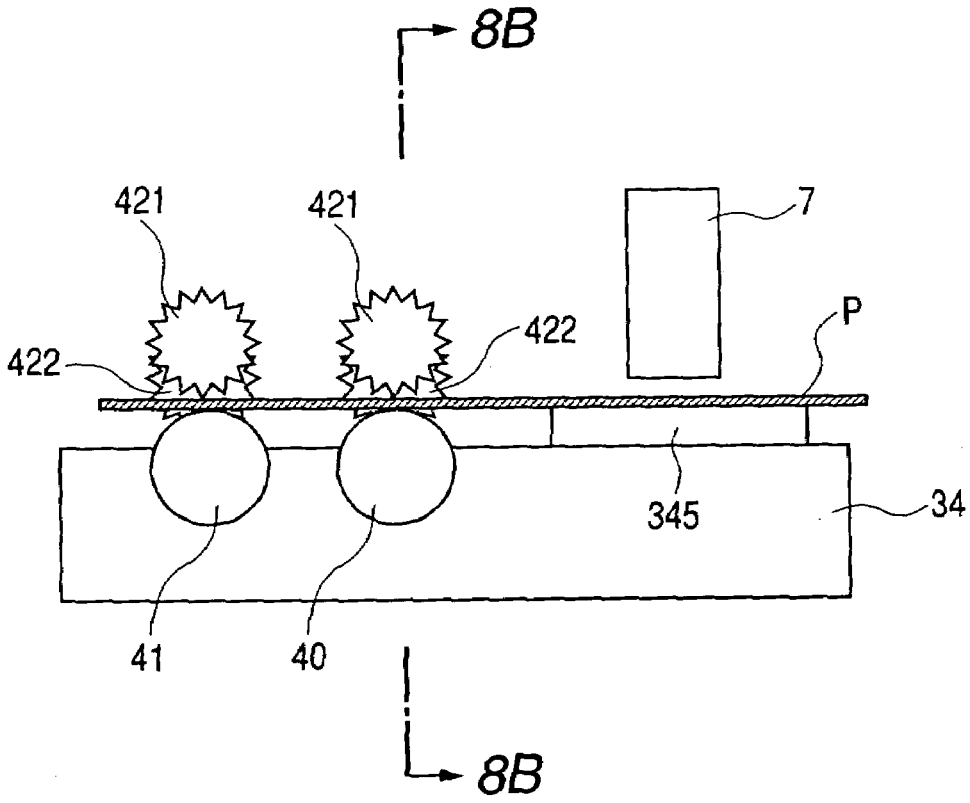
FIGS. 8A and 8B show a cross section of the both-side recording apparatus according to the first embodiment of the present invention during recording on the reverse side of the recording medium and the state of the recording medium.
Figure 8B:
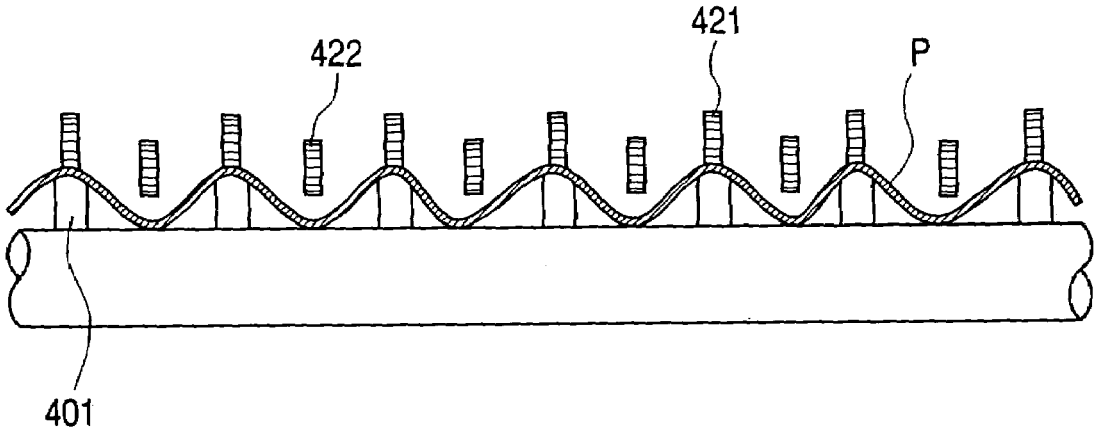

So, in the present embodiment, recording is not done in this state, but the recording medium P is once conveyed to the sheet expelling portion (the step 508 of FIG. 5). FIG. 8A shows a state in which the recording medium P has been conveyed to the sheet expelling portion. Also, FIG. 8B shows the situation of the paper floating of the recording medium P in the vicinity of the sheet expelling roller 40 (a cross section 8B—8B in FIG. 8A).

Figure 9A:
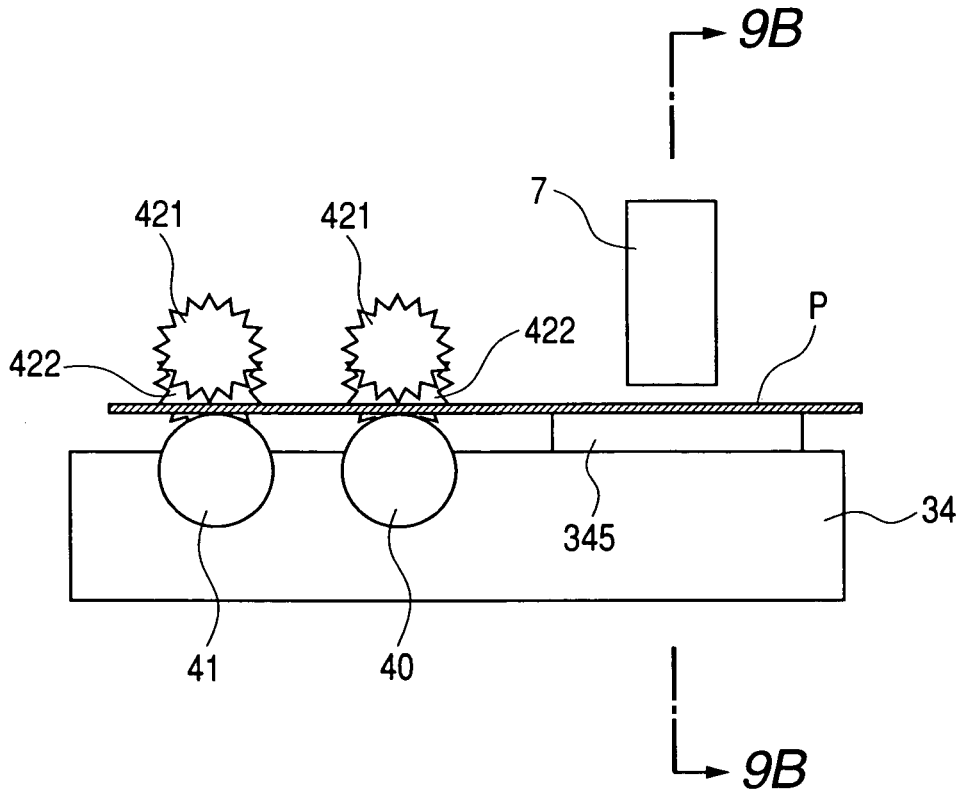
FIGS. 9A and 9B show a cross section of the both-side recording apparatus according to the first embodiment of the present invention during recording on the reverse side of the recording medium and the state of the recording medium.
Figure 9B:
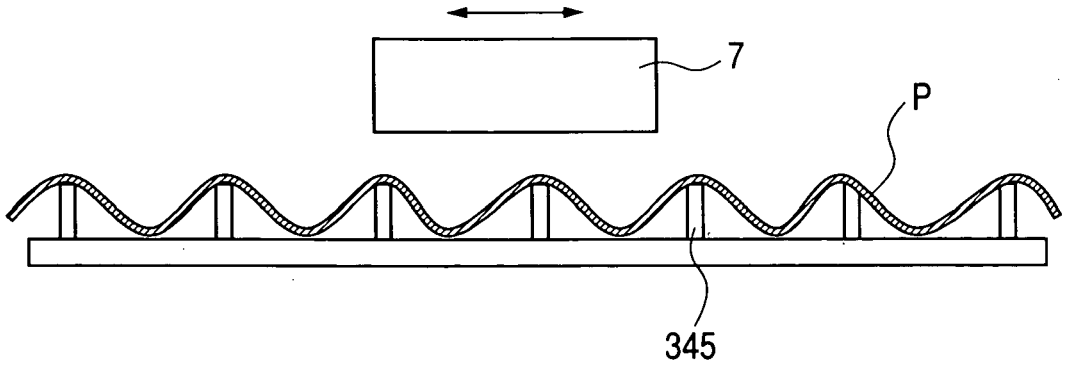

When the recording medium P enters the sheet expelling portion, the uneven waving is reversed by the action of the push-in spurs 422. That is, the push-in spurs 422 push down the convex portions, whereby the convex portions become concave portions, and the degree of waving is reduced. Thereafter, the recording medium P is again conveyed to the recording head 7. FIG. 9A shows the state of the recording medium P when the recording medium P has been conveyed in the opposite direction to the recording head 7 after it has been thus passed through the sheet expelling portion. Also, FIG. 9B shows the situation of the paper floating of the recording medium P light beneath the recording head 7 (a cross section 9B—9B in FIG. 9A). The recording medium P has its waving thus suppressed by the action of the push-in spurs 422, and is restored to a state similar to that when recording is effected on the front side, i.e., the same state as that shown in FIGS. 6A and 6B. Thereafter, the steps 502 and 503 are repeated until the recording data to be conveyed becomes absent. The recording medium P having had its waving shape adjusted in advance in this manner also maintains the same shape during recording on the reverse side, and it becomes possible to suppress the paper floating toward the recording head 7 side.

It is desirable that the imparting of this unevenness be effected up to the trailing edge portion of the recording medium P, and it is desirable that the recording medium P be conveyed to a position at which the portion thereof which is near the trailing edge is pushed in by the push-in spurs 422, or a position at which the trailing edge passes the push-in spurs 422.

However, before recording, the recording medium should enter the sheet expelling portion and unevenness should be imparted earlier to the vicinity of the leading edge on which recording is effected with at least the leading edge of the recording medium P being not nipped by the sheet expelling portion. If thereafter, the recording progresses and the leading edge of the recording medium P is nipped by the sheet expelling portion, the unevenness of waving formed thereon extends even to a portion opposed to the recording head 7.

Figure 10:
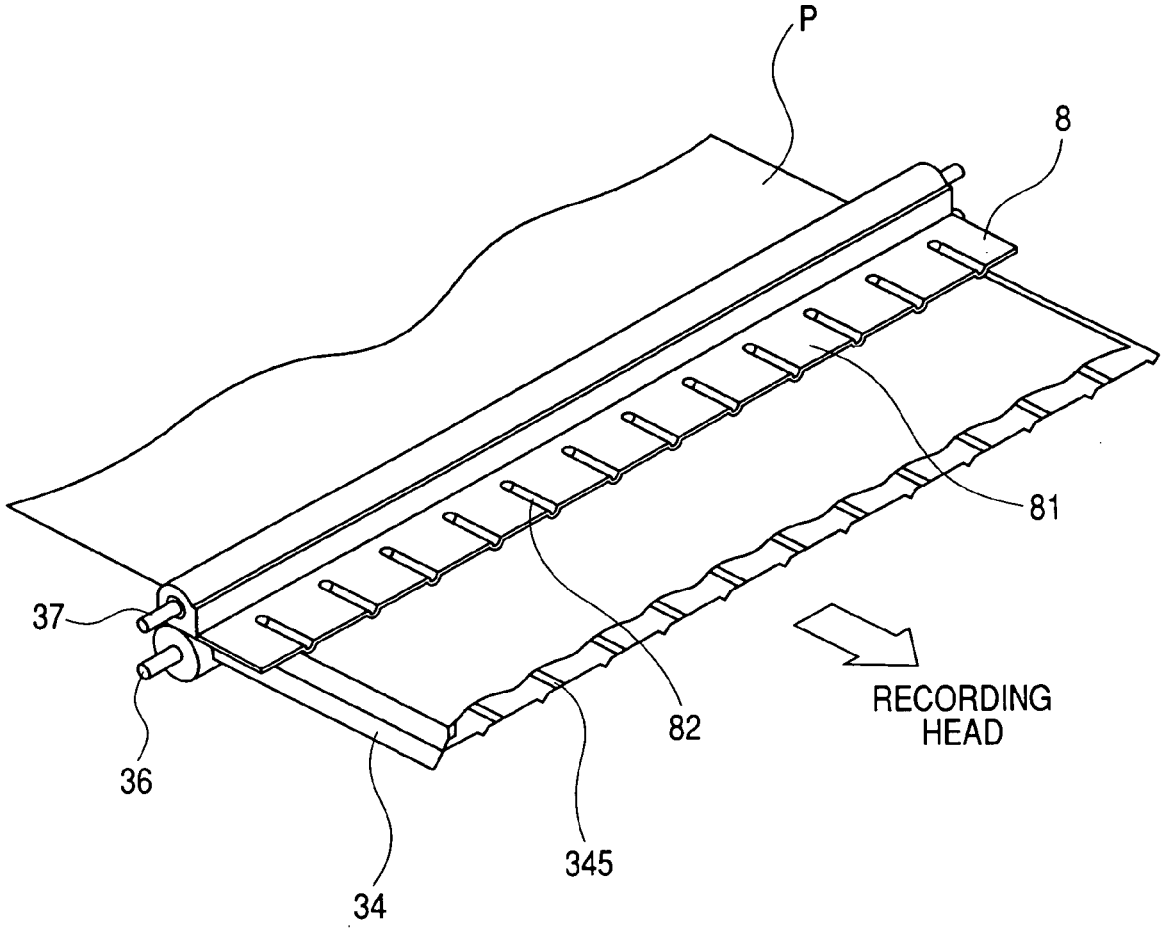
FIG. 10 is a schematic view of the sheet conveying portion of a both-side recording apparatus according to a second embodiment of the present invention.
Figure 11:
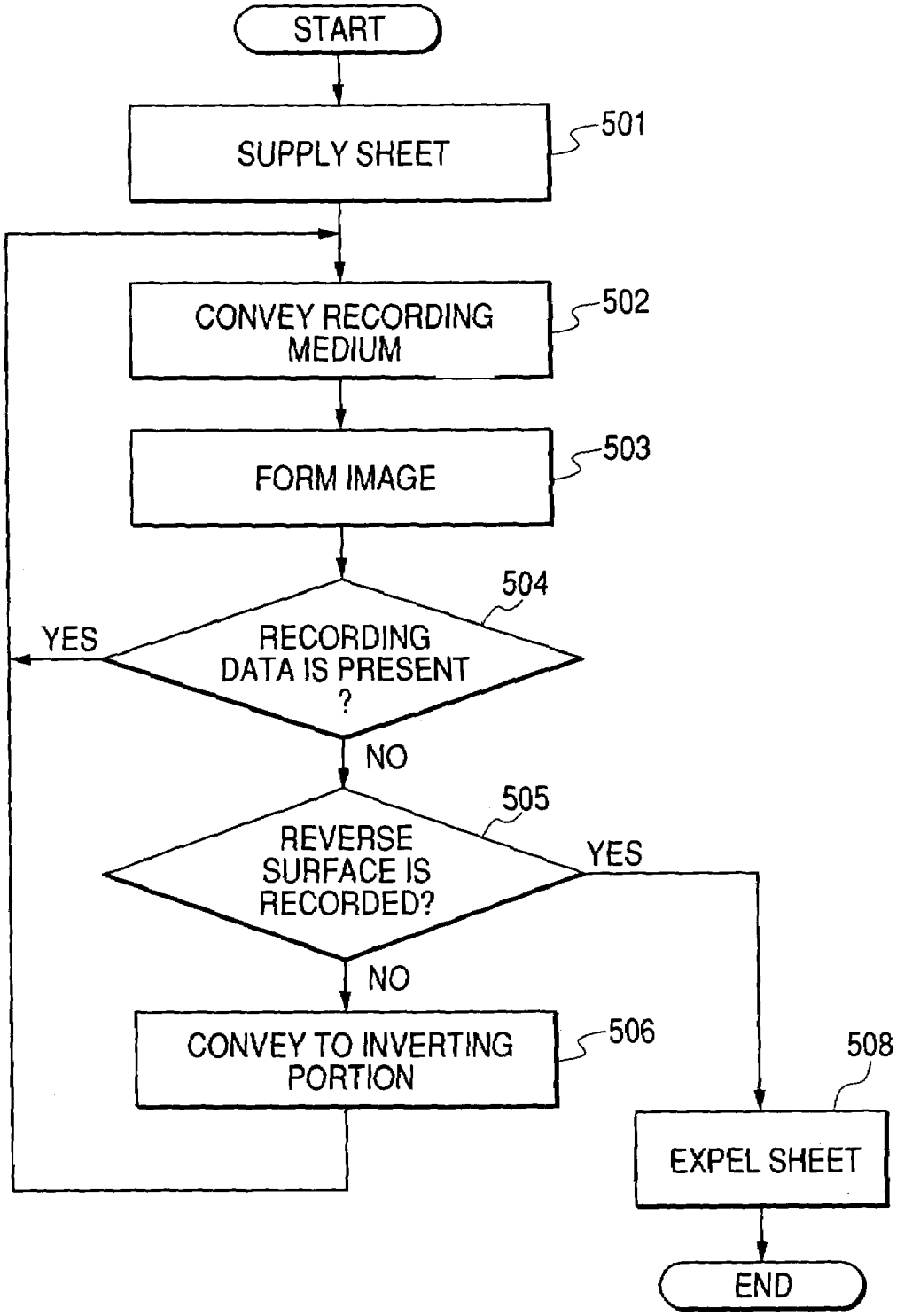
FIG. 11 is a flow chart showing the recording method of the both-side recording apparatus according to the second embodiment of the present invention.

A second embodiment of the present invention will now be described with reference to FIGS. 10 to 13A and 13B. FIG. 10 shows the configuration of a paper pressing plate 8 provided in a both-side recording apparatus according to the second embodiment of the present invention. FIG. 11 is a flow chart showing a series of steps of effecting recording on the recording medium P. FIGS. 12A, 12B, 13A and 13B are typical views showing the states of the recording medium P at the main steps shown in FIG. 11.

The present embodiment differs from the first embodiment in that the paper pressing plate 8 is used as the first unevenness imparting means. The paper pressing plate 8 is disposed between the conveying roller 36, the pinch rollers 37 and the recording head 7. That is, the paper pressing plate 8 is provided on a common route between the sheet supplying portion and the carriage portion and between the inverting portion and the carriage portion, and design is made such that the recording medium P passes the paper pressing plate 8 both when recording is effected on the front side of recording medium and when recording is effected on the reverse side thereof.

The paper pressing plate 8 has a horizontal portion 81 and a plurality of projections 82. The projections 82 are provided at a predetermined pitch in a direction downwardly protruding from the underside of the horizontal portion 81 in parallelism to the conveying direction of the recording medium P and substantially at the intermediate positions of the respective ribs 345. Also, the horizontal portion 81 is in contact with the ribs 345.

A method of recording an image on the recording medium P in the present embodiment will now be described with reference to FIG. 11. The basic procedure is similar to that in the first embodiment, but the present embodiment differs in that the conveyance to the sheet expelling portion (the step 507 of FIG. 5) which has been necessary in the first embodiment is unnecessary. That is, the present embodiment differs from the first embodiment in that when recording on the front side of the recording medium P is completed, and recording is to be effected on the reverse side after the inversion of the front side and reverse side in the inverting portion, the step of once conveying the recording medium P to the sheet expelling portion, and thereafter conveying it in the opposite direction is omitted, and immediately recording on the reverse side is effected.

Here, how the waving phenomenon of the recording medium P is controlled in the above-described recording method will be described with reference to FIGS. 12A, 12B, 13A and 13B. In each of these figures, A and B typically show the position of the recording medium P in the conveying direction thereof, and the situation of the paper floating of the recording medium P as it is seen from the conveying direction, respectively.

Figure 12A:
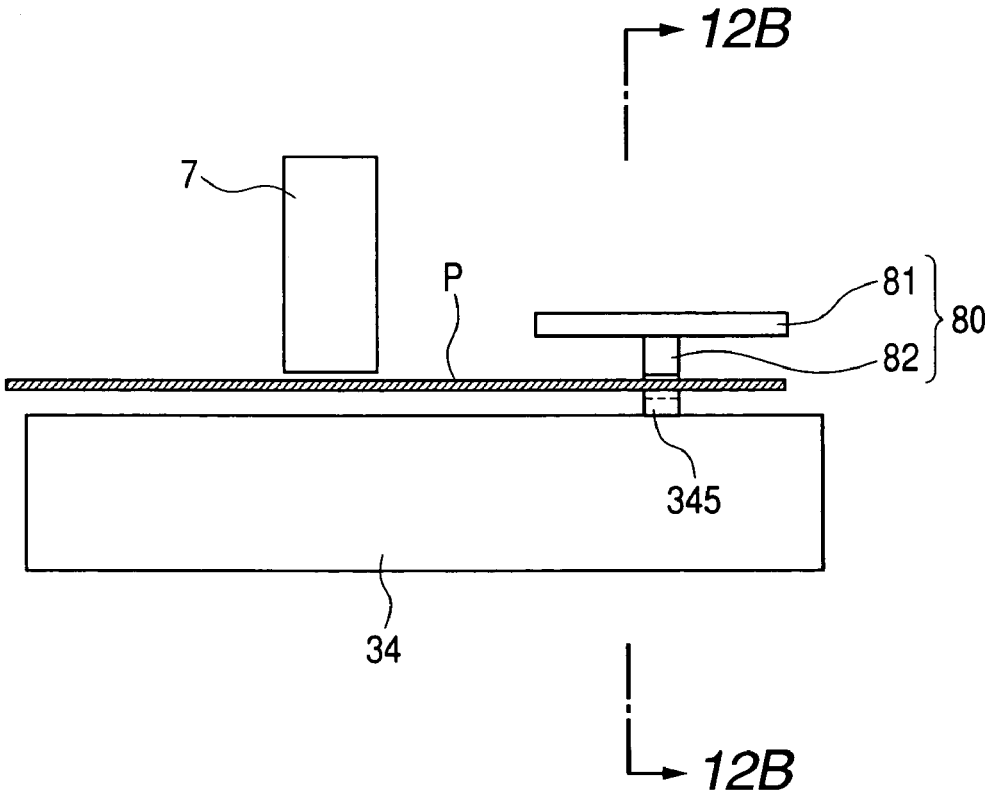
FIGS. 12A and 12B show a cross section of the both-side recording apparatus according to the second embodiment of the present invention during recording on the front side of a recording medium and the state of the recording medium.

FIG. 12A shows a state in which several lines have been recorded on the front side of the recording medium P. The recording medium P is in a state in which it has passed the conveying roller 36, the pinch rollers 37 (not shown) and the paper pressing plate 8 and a portion thereof has come to under the recording head 7.

Figure 12B:
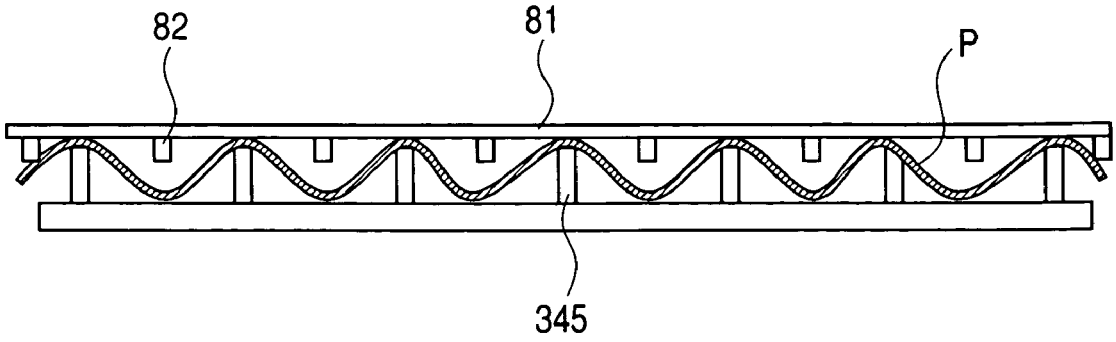

FIG. 12B shows the situation of the paper floating of the recording medium P in the paper pressing plate 8 portion. A plurality of uneven waving shapes are formed in the recording medium P by the action of the ribs 345 provided on the platen 34 and the paper pressing plate 8. The height of the waving of the recording medium P is suppressed within the height of the ribs 345 and therefore, it becomes possible to suppress such great paper floating that the recording head 7 and the recording medium P come into contact with each other.

Figure 13A:
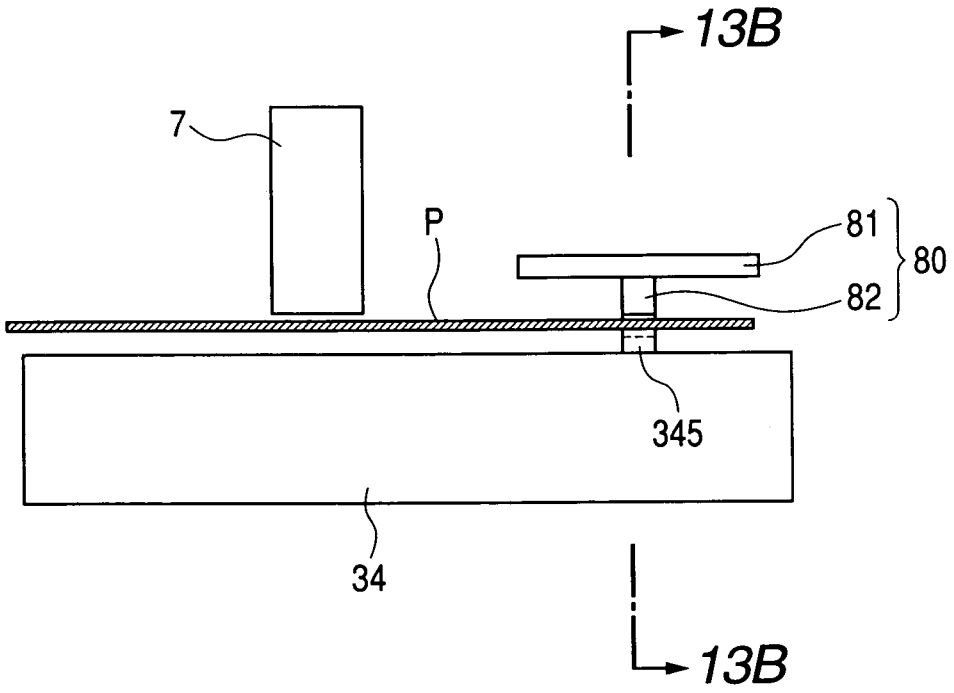
FIGS. 13A and 13B show a cross section of the both-side recording apparatus according to the second embodiment of the present invention during recording on the reverse side of the recording medium and the state of the recording medium.
Figure 13B:
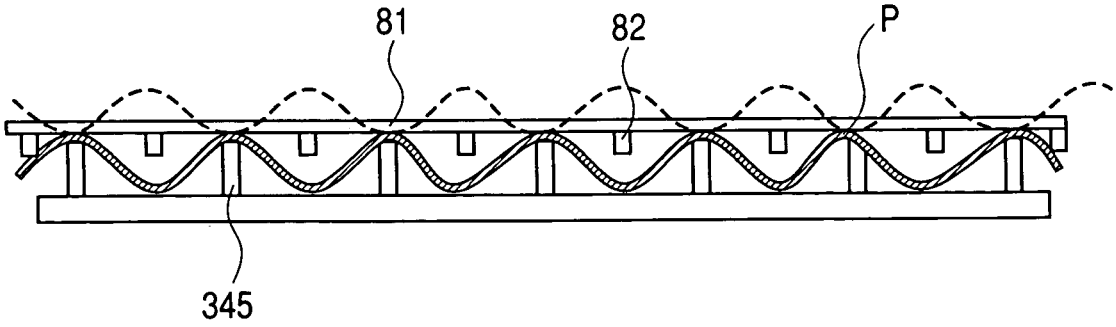

FIG. 13A shows the situation at a point of time whereat the recording medium P has been conveyed to the inverting portion (the step 506 of FIG. 11), and has again been conveyed to the recording head 7. Also, FIG. 13B shows the situation of the paper floating of the recording medium P at this time (a cross section 13B—13B in FIG. 13A). The broken like depicts the state of the recording medium P when the paper pressing plate 8 is absent. If the paper pressing plate 8 is absent, the recording medium P is inverted with a result that the unevenness is vertically inverted about the ribs 345, and those portion which were concave portions before inverted become convex portions. Actually, however, by the presence of the paper pressing plate 8, the unevenness of the waving of the recording medium P is reversed. That is, the convex portions of the recording medium P is downwardly pushed by the projections 82, and the convex portions become concave portions, and the size of the waving is reduced. The recording medium P having had its waving shape thus adjusted in advance is conveyed to the recording head 7 portion in that state, and maintains the same shape also during the recording on the reverse side, and it becomes possible to suppress the paper floating toward the recording head 7 side.

In the present embodiment, the inverting means, the uneven shape imparting means and the recording means are disposed in the conveying direction of the recording medium P in the named order and therefore, simply by conveying the recording medium P in one direction, it becomes possible to effect recording without causing excessively great waving to the recording medium P, and it is possible to shorten the recording time.

Also, while in this embodiment, the paper pressing plate 8 is used as a construction for forcibly imparting unevenness to the recording medium P, it is possible to obtain a similar effect by unevenness imparting means by a rotary member, for example, a combination of the sheet expelling roller and the spurs used in the first embodiment.

It is also possible to use the combination of the sheet expelling rollers 40, 41 and the spurs 42 used in the first embodiment together with the paper pressing plate 8 used in the present embodiment, and in this case, a greater effect will be obtained.

Further, while the foregoing embodiments have been described with a serial type both-side recording apparatus as the subject, the present invention is not restricted thereto, but can also be applied to a so-called full line type recording apparatus.

What is claimed is:

1. A both-side recording apparatus for effecting recording on both sides of a recording medium while conveying said recording medium, said apparatus comprising first unevenness imparting means for imparting an uneven shape to said recording medium;

recording means for recording an image on a recording medium by discharging ink; and an inverting portion in which a front side and a reverse side of said recording medium are inverted, wherein said first unevenness imparting means is disposed on a downstream side of said recording means in the conveying direction and said inverting portion is disposed on an upstream side of said recording means in the conveying direction, wherein said first unevenness imparting means comprises a plurality of ribs extending in the conveying direction of said recording medium and a rotary member for pushing said recording medium between said ribs, and wherein after recording has been effected on the front side of said recording medium and the recording medium is inverted in the inverting portion, the recording medium is conveyed to said first unevenness imparting means, and then the recording medium is conveyed in a reverse direction and recording is effected on the reverse side of said recording medium.

2. A both-side recording apparatus according to claim 1, further having second unevenness imparting means provided at a location substantially opposed to recording means for effecting recording on said recording medium for imparting an uneven shape to said recording medium in the plane orthogonal to the conveying direction of said recording medium when recording is effected on each of the front side and the reverse side of said recording medium.

3. A both-side recording apparatus according to claim 2, wherein said first unevenness imparting means is provided in a portion common to a route from a sheet supplying portion for said recording medium to said recording means and a route from an inverting portion in which a front side and a reverse side of said recording medium are inverted to said recording means.

4. A both-side recording apparatus according to claim 2, wherein said first unevenness imparting means is provided between said recording means and a sheet expelling portion, and unevenness is imparted to said recording medium by said first unevenness imparting means after recording has been effected on the front side of said recording medium and before recording is effected on the reverse side of said recording medium.

5. A both-side recording apparatus according to claim 2, wherein said second unevenness imparting means is a platen provided with a plurality of ribs extending in the conveying direction of said recording medium.

6. A both-side recording apparatus according to claim 1, wherein said first unevenness imparting means comprises a rotary member having a plurality of roller portions in the direction orthogonal to the conveying direction of said recording medium in the plane of said recording medium, conveying spurs for nipping said recording medium between it and each of said roller portions, and a plurality of push-in spurs dispersed between said conveying spurs, and said push-in spurs push in said recording medium, whereby a convex portion of said recording medium is formed in that portion of said recording medium which contacts with said roller portions.

7. A both-side recording apparatus according to claim 1, wherein said first unevenness imparting means comprises a plurality of ribs extending in the conveying direction of said recording medium, and a paper pressing plate for nipping said recording medium between it and said ribs, said paper pressing plate has a plurality of projections disposed between said ribs substantially in parallel to said ribs, and said projections push in said recording medium, whereby a convex portion of said recording medium is formed on a portion thereof which contacts with said ribs.

8. A both-side recording apparatus according to claim 7, wherein said projections are rotary members rotatable in the conveying direction of said recording medium.

9. An image forming apparatus for effecting recording on a recording medium at a recording position by the use of recording means for discharging ink, having:

conveying means for conveying the recording medium in a predetermined conveying direction at said recording position to effect recording by said recording means;

unevenness imparting means disposed downstream of said recording position with respect to said predetermined conveying direction for imparting an uneven shape to the recording medium conveyed by said conveying means;

an inverting portion for inverting a front side and a reverse side of the recording medium conveyed in a direction opposite to said predetermined conveying direction from said recording position by said conveying means, and conveying the recording medium to said conveying means; and control means for controlling said conveying means so as to convey the recording medium to the unevenness imparting means from said inverting portion, thereafter recording being effected after the recording medium is returned to said recording means subsequent to when recording has been effected on the front side of the recording medium by said recording means, and recording is to be effected on the recording medium having had its front side and reverse side inverted by said inverting portion.

10. An image forming apparatus according to claim 9, wherein when recording has been effected on the front side by said recording means and recording is to be effected on the recording medium having had its front side and reverse side inverted by said inverting portion, said control means controls said conveying means so as to convey the recording medium to the unevenness imparting means in order to impart unevenness by said unevenness imparting means before the recording by said recording means, and thereafter convey the recording medium in a direction opposite to said predetermined conveying direction in order to effect recording from a leading edge portion of the recording medium by said recording means.

11. An image forming apparatus according to claim 10, wherein said unevenness imparting means has a roller provided with a plurality of roller portions at intervals, and a rotary member for pushing the recording medium between said roller portions.

12. An image forming apparatus according to claim 11, further having a platen provided with a plurality of ribs for guiding the recording medium at said recording position.

13. An image forming apparatus according to claim 12, wherein said roller portions are disposed on a straight line extended in the conveying direction from said ribs.

14. An image forming apparatus according to claim 10, wherein said control means controls said conveying means so as to convey the recording medium to a position at which unevenness is imparted to at least the vicinity of a leading edge portion of the recording medium by the unevenness imparting means in order that unevenness may be imparted to at least the vicinity of the leading edge portion of the recording medium having had its front side and reverse side inverted by said inverting portion.

15. An image forming apparatus according to claim 10, wherein said control means controls said conveying means so as to convey the recording medium to a position at which unevenness is imparted to the whole of the recording medium by the unevenness imparting means in order that unevenness may be imparted to the whole of the recording medium having had its front side and reverse side inverted by said inverting portion.

* * * * *

UNITED STATES PATENT AND TRADEMARK OFFICE

CERTIFICATE OF CORRECTION

PATENT NO. : 7,021,757 B2
APPLICATION NO. : 10/899075
DATED : April 4, 2006
INVENTOR(S) : Akira Kida It is certified that error appears in the above-identified patent and that said Letters Patent is hereby corrected as shown below:

COLUMN 3:
Line 24, "provided" should read --be provided--.

COLUMN 12:
Line 45, "like" should read --line--.
Line 50, "portion" should read --portions--.

Signed and Sealed this

Tenth Day of October, 2006

JON W. DUDAS
*Director of the United States Patent and Trademark Office*